United States Patent [19]

Chuang et al.

[11] Patent Number: 4,556,450

[45] Date of Patent: Dec. 3, 1985

[54] METHOD OF AND APPARATUS FOR REMOVING LIQUID FOR WEBS OF POROUS MATERIAL

[75] Inventors: Strong C. Chuang, Cincinnati; Hugh A. Thompson, Fairfield, both of Ohio

[73] Assignee: The Procter & Gamble Company, Cincinnati, Ohio

[21] Appl. No.: 454,808

[22] Filed: Dec. 30, 1982

[51] Int. Cl.[4] ..... D21F 5/02

[52] U.S. Cl. ..... 162/204; 34/9; 34/16; 34/92; 34/95.3; 34/109; 34/123

[58] Field of Search ..... 34/9, 16, 92, 95, 113, 34/116, 123, 95.3, 109; 162/204

[56] References Cited

U.S. PATENT DOCUMENTS

| | | | |
|---|---|---|---|
| 3,262,840 | 7/1966 | Hervey | 162/205 |
| 3,301,746 | 1/1967 | Sanford et al. | 162/113 |
| 3,327,866 | 6/1967 | Pall et al. | 210/499 |
| 4,238,284 | 12/1980 | Huostilla et al. | 162/207 |
| 4,357,758 | 11/1982 | Lampinen | 34/9 |

OTHER PUBLICATIONS

Burgeni et al., *Textile Research Journal*, May 1967, pp. 356–366.

*Primary Examiner*—William F. Smith

*Attorney, Agent, or Firm*—Thomas J. Slone; Fredrick H. Braun; Richard C. Witte

[57] ABSTRACT

An apparatus for removing water or other liquids from webs of such porous materials as fibrous paper webs coursing through a papermaking machine without substantially compacting the webs. The web which may be coherent or perforate passes over a sector of a cylinder having preferential-capillary-size pores through its cylindrical-shape porous cover. Preferably, the porous cover comprises hydrophilic material which is substantially non-resilient and which renders the surfaces of the porous cover wettable by the liquid of interest. A portion of the interior of the cylinder may be subjected to a controlled level of vacuum to effect pneumatically augmented capillary flow of liquid from the web; and another portion of the cylinder may be subjected to pneumatic pressure for expelling the transferred liquid outwardly through a portion of the porous cover which is not in contact with the web. The method may comprise controlling the level of vacuum as a function of air flow to maximize liquid removal from a web while substantially obviating air flow through the capillary-size pores of the porous cover of the cylinder. Preferential-capillary-size pores are such that, relative to the pores of a wet porous web, normal capillary flow would preferentially occur from the pores of the web into the preferential-capillary-size pores of the porous cover when the web and porous cover are juxtaposed in surface-to-surface contact.

16 Claims, 21 Drawing Figures

METHOD OF AND APPARATUS FOR REMOVING LIQUID FOR WEBS OF POROUS MATERIAL

DESCRIPTION

Technical Field

This invention pertains to removing liquids from porous webs and other porous media: for example, water from a continuous, high bulk, water saturated porous paper web in the wet end of a papermaking machine.

Background Art

U.S. Pat. No. 3,262,840 which issued July 26, 1966 to L. R. B. Hervey, discloses a Method And Apparatus For Removing Liquids From Fibrous Articles Using A Porous Polyamide Body: for example, resilient porous sintered nylon rolls for use in pressure biased press nips. Such rolls may have vacuum applied to their interiors to promote flow of liquid into the rolls from articles such as paper webs from which liquid is to be removed. Liquid transfer into such rolls from, for instance, wet paper webs is apparently probably effected by the combination of nip pressure, some degree of capillary action, and vacuum assistance. Such transfer must, however, necessarily be very fast at least with respect to rolls of reasonable diameter at contemporary papermaking velocities due to having to occur during the relatively short time the web traverses a nip between opposed rolls; that is, without wrapping a sector of a porous roll. Liquid may subsequently be removed from such rolls either internally as by vacuum, or pneumatically outward by positive pressure applied internally to suitably internally compartmentalized rolls.

U.S. Pat. No. 4,357,758, which issued Nov. 9, 1982 to Markku Lampinen and which was derived from Priority Application Number 802106 having a Priority Date of July 1, 1980 in Finland discloses a Method and Apparatus For Drying Objects which involves a fine-porous suction surface saturated with liquid brought into hydraulic contact with a liquid that has been placed under reduced pressure with reference to the object to be dried. Briefly, with respect to cylindrical embodiments, this apparently entails maintaining an annular body of liquid immediately subjacent a fine-porous surface of the cylinder, and maintaining the annular body of liquid under reduced pressure with respect to the object to be dried. With respect to papermaking, the wet paper web would wrap a circumferential length of the cylinder, and the annular body of liquid would commonly be water which is apparently continuously maintained at a sub-atmospheric pressure by suction pumps. Additionally, Capillary Sorption Equilibria in Fiber Masses has been published in Volume 37, Issue 5 of the Textile Research Journal by A. A. Burgeni and C. Kapur.

U.S. Pat. No. 4,238,284 which issued Dec. 9, 1980 to Markku Huostila et al discloses a Method For Dewatering A Tissue Web. This patent discloses transferring a paper web from a forming wire onto a felt carrier fabric trained about a sector of a vacuum pick-up roll; and then transferring the web onto a drying fabric just downstream from where the felt carrier fabric, the web and the drying fabric are trained about a sector of a second vacuum roll. The web is said to be progressively dewatered to a consistency of from about 22 to about 27 percent prior to being transferred from the felt carrier fabric. Water removal from the web while it is on the felt carrier fabric is said to be effected by vacuum in the two rolls, and capillarily into a free span of the felt which extends intermediate the rollers. While this is said to reduce the energy requirement to remove water from the web, it concomitantly requires substantial means and energy for dewatering the absorbent felt.

While the background art discloses some aspects of dewatering such things as wet paper webs coursing through papermaking machines through the use of members having capillary-size pores, and has solved some of the problems incident thereto, the background art has not solved such problems to the extent provided by the present invention: for example, the present invention enables such dewatering of a paper web without compacting the web as would be precipitated by, for example, passing through a nip between opposed rolls; without requiring a hydraulic connection between a liquid saturated surface and a body of liquid which is continuously maintained at a sub-ambient pressure; and without using a capillary member made from such an absorptive material as felt which itself precipitates further dewatering problems.

DISCLOSURE OF THE INVENTION

In accordance with one aspect of the invention, a method and apparatus are provided for removing water or another liquid from a continuous wet porous web on the run; e.g., as a newly formed, water saturated paper web courses through the wet end of a papermaking machine. The continuous wet web is led onto and away from a rotatably mounted capillary cylinder so that it wraps a predetermined sector of the cylinder. The cylinder has a porous cover wherein the pores are preferential-capillary-size with respect to the pores of the web, and which pores are substantially uniform in size: i.e., which have a small range of sizes. That is, they are effectively smaller than the pores of the web and are so substantially uniform in size that some of the liquid is capillarily transferred from the pores of the web into the pores of the porous cover of the cylinder as the cylinder rotates. The transferred liquid may subsequently be pneumatically expelled outwardly from the pores of the porous cover after the web has been led away from it whereby the pneumatically expelled water does not rewet the web. The method may further include applying a vacuum within the cylinder so that it acts across the web and the porous cover to pneumatically augment the capillary transfer of water from the web into the porous cover; and the method may include pneumatic removal of the liquid from the cylinder as by pneumatically expelling the liquid outwardly from the span of the cover which is not wrapped by the web. The level of vacuum may be controlled to maximize the amount of liquid transferred from the web while concomitantly maintaining liquid-seals in the pores of the porous shell; and/or the level of pneumatic pressure for effecting liquid removal may be controlled to maximize the expulsion of liquid while concomitantly maintaining liquid-seals in the pores of the porous shell. The apparatus may include stationary means for applying such vacuum and/or pneumatic pressure subjacent various sectors of the porous cover as the cylinder rotates; and means for automatically controlling the levels thereof to maximize the water removal energy efficiency of the apparatus.

BRIEF DESCRIPTIONS OF THE DRAWINGS

While the specification concludes with claims particularly pointing out and distinctly claiming the subject matter regarded as forming the present invention, it is believed the invention will be better understood from the following description taken in conjunction with the accompanying drawings in which:

Figure 1:
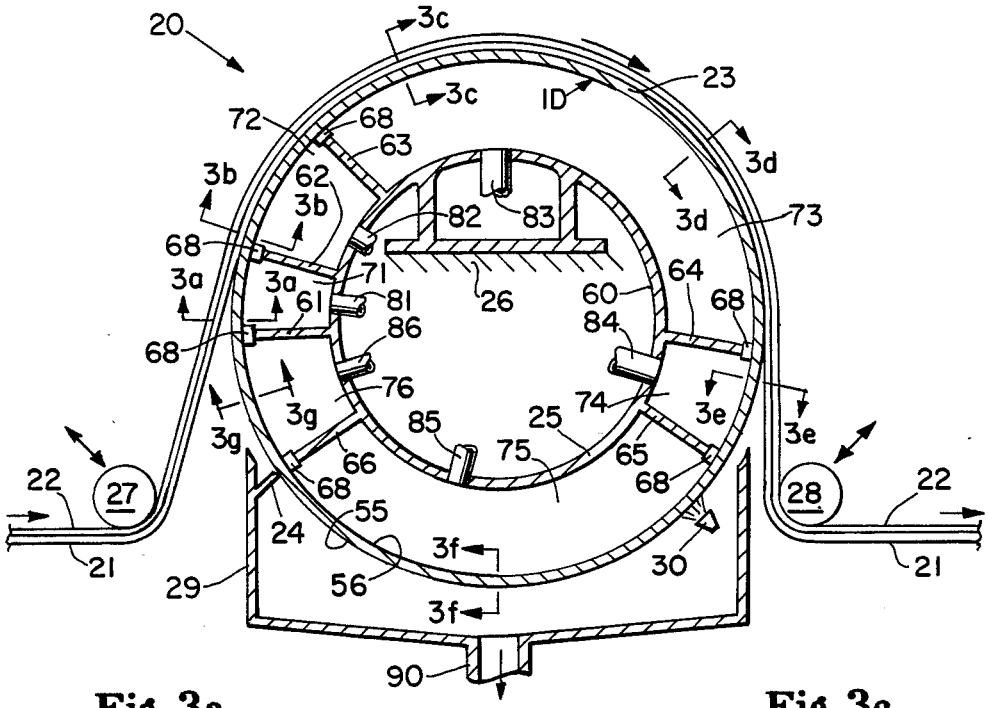
FIG. 1 is a fragmentary, somewhat schematic, side elevational sectional view of a capillary cylinder and ancillary apparatus with which the method of the present invention may be practiced.

FIGS. 3*a* through 3*g* are greatly enlarged scale, fragmentary sectional views taken along sectional lines 3*a*—3*a* through 3*g*—3*g*, respectively, of FIG. 1.

FIGS. 4*a* through 4*g* are greatly enlarged scale, fragmentary sectional views of an alternate embodiment capillary cylinder which views correspond to views 3*a* through 3*g*, respectively.

Figure 5:
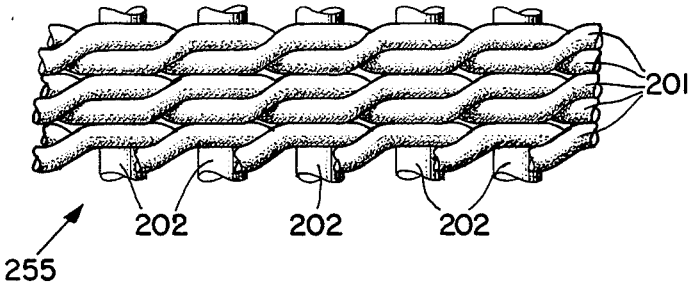

FIG. 5 is a fragmentary plan view of a woven-wire capillary member which may be used as a porous cover for capillary cylinders such as shown in FIG. 1.

Figure 6:
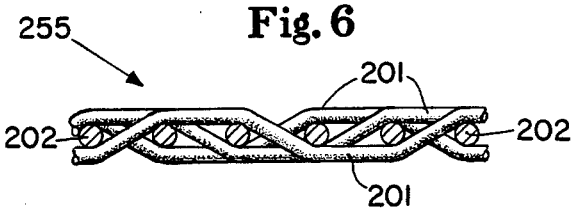

FIG. 6 is a fragmentary side elevational view of the woven-wire capillary member shown in FIG. 5.

Figure 3A:
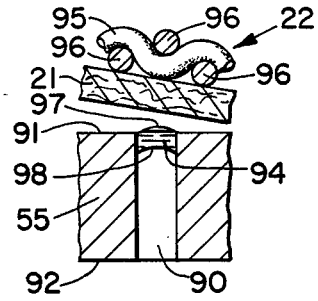
Figure 4A:
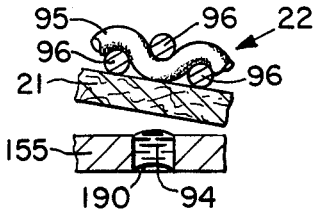
Figure 4B:
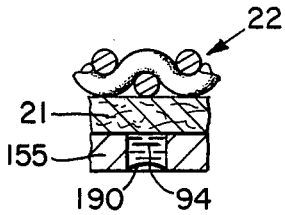
Figure 7:
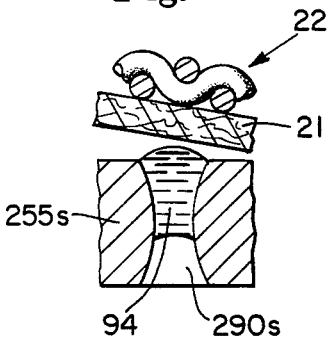

FIG. 7 is a somewhat schematic sectional view of an alternate capillary member, web, and carrier fabric which corresponds to FIGS. 3*a* and 4*a* but in which the capillary pores are convergent/divergent in shape.

Figure 8:
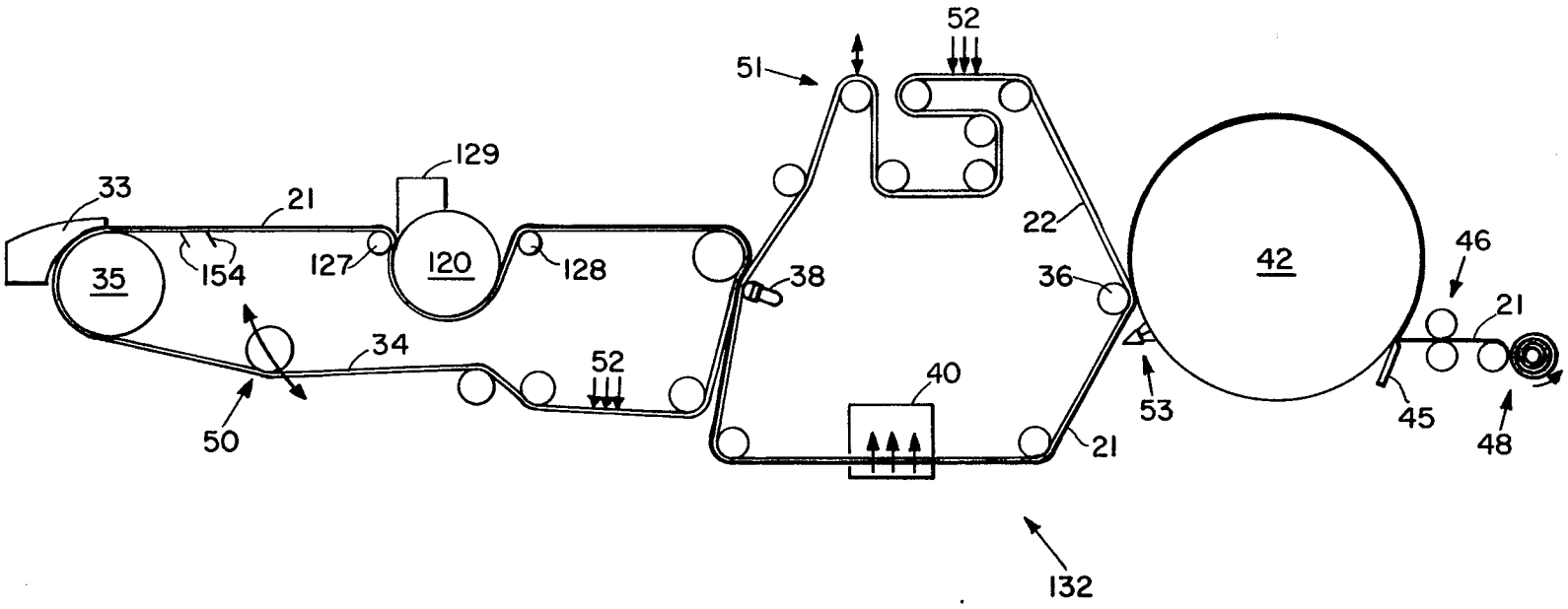

FIG. 8 is a somewhat schematic side elevational view of an alternate papermaking machine which incorporates a capillary cylinder in its Fourdrinier run in accordance with the present invention.

Figure 9:
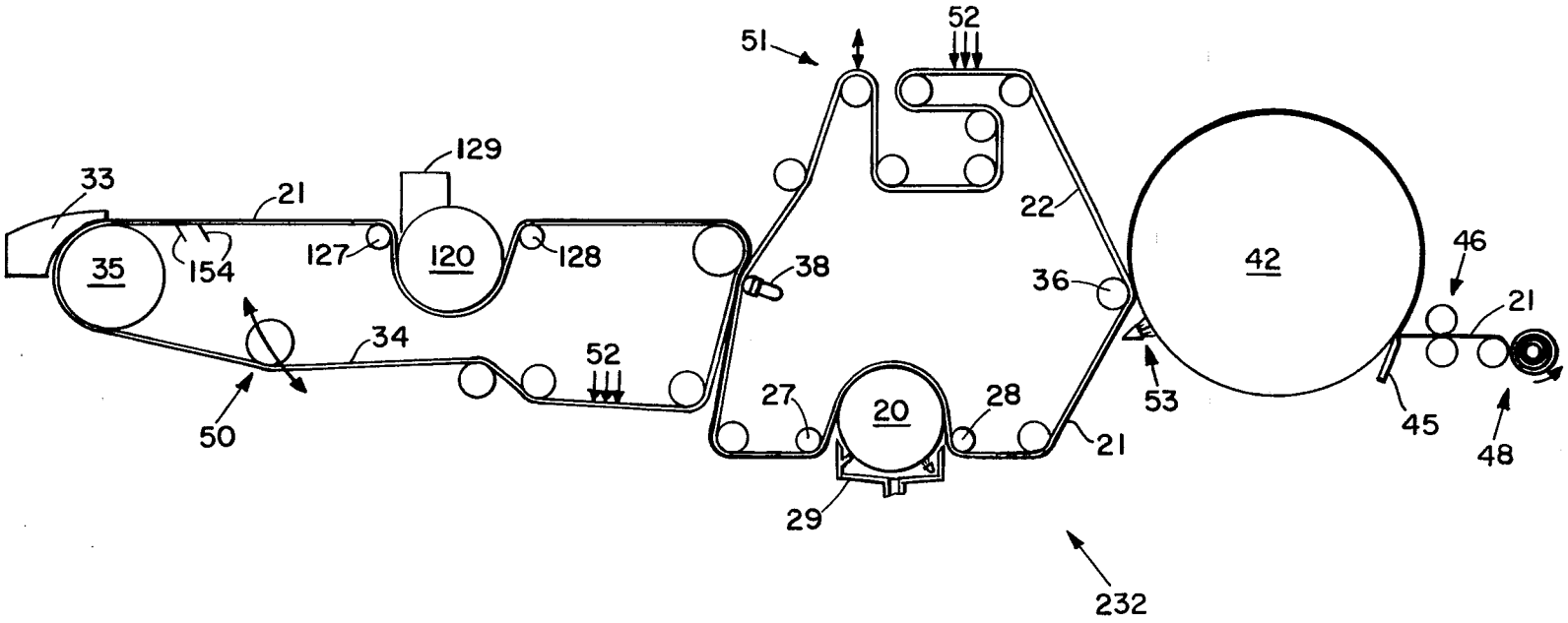

FIG. 9 is a somewhat schematic side elevational view of another alternate papermaking machine which incorporates two capillary cylinders in accordance with the present invention.

DETAILED DESCRIPTION OF THE INVENTION

FIG. 1 is a somewhat schematic fragmentary sectional view of an exemplary capillary cylinder 20 along with adjacent ancillary apparatus which together embody the present invention and with which the method of the present invention may be practiced. FIG. 1 also shows a paper web 21 disposed on a carrier fabric 22 circumferentially wrapping a substantial, predetermined sector of cylinder 20. Cylinder 20 comprises a rotatably mounted cylindrical porous shell 23, and a stationary (i.e., non-rotatable) internal manifold assembly 25. The ancillary apparatus shown in FIG. 1 includes a fragmentary portion of frame 26, idler rolls 27 and 28, and drainage trough 29. Shower means 30 are directed against the outside surface of cylinder 20 within trough 29, and a doctor blade 24 is disposed in contacting relation with the outside surface of cylinder 20 at the exit from trough 29 for the purpose of doctoring excess water from the surface of cylinder 20 before the surface is again covered by web 21. Means not shown are also provided for mechanically supporting and rotatably mounting porous shell 23 for rotation about its axis of generation; and means for rotating porous shell 23 at controlled rotational velocities. Also, means schematically indicated by the arrows adjacent idler rolls 27 and 28 are provided for adjusting their positions with respect to cylinder 20 in order to adjust the sector of cylinder 20 which is wrapped by web 21, as well as the o'clock positions of the points at which web 21 first contacts and then ceases contact with cylinder 20.

Capillary cylinder 20, FIG. 1, may be operated to remove liquids from various continuous webs. The following description is of its use in the wet end of a papermaking machine for the purpose of at least partially dewatering a newly formed, water saturated, continuous web comprising papermaking fibers. It is, however, not intended to thereby limit the scope of the present invention to either such dewatering, or to papermaking, or to any particular papermaking machine geometry.

Briefly, still referring to FIG. 1, water is removed from web 21 into cylinder 20 through capillary-size pores in a porous cover of shell 23 which pores are effectively smaller than the pores of web 21: i.e., smaller effective diameters than the effective diameters of the pores of the medium to be dewatered. As used herein, the term effective pore diameter means that the pore acts, at least in the capillary sense, the same as a cylindrical pore of the stated diameter albeit the pore of interest may have an irregular shape; i.e., not circular or cylindrical. The pores of the porous cover are denominated preferential-capillary-size pores with respect to the pores of the web. The pores of the porous cover are also preferably of substantially uniform size: That is, they preferably have a very narrow range of effective diameters: preferably such that ninety (90) percent or greater and more preferably ninety-five (95) percent or greater of the pores have a nominal effective diameter size plus or minus fifteen (15) percent; or, more preferably plus or minus ten (10) percent; or most preferably plus or minus five (5) percent or less inasmuch as potential energy savings are inversely related to the pore size range. The water transfer may be effected by capillary action per se and/or may be pneumatically augmented by drawing a controlled level of vacuum subjacent a sector of the porous cover. In the embodiment shown, the transferred water is then pneumatically expelled outwardly from the pores of the porous cover of shell 23 into trough 29. It is, however, not intended to preclude removal of water from inside cylinder 20 by conventional means such as suction means and the like. Also, the passing porous cover of shell 23 is continuously showered by a high pressure spray from shower head 30 to remove foreign matter.

Figure 2:
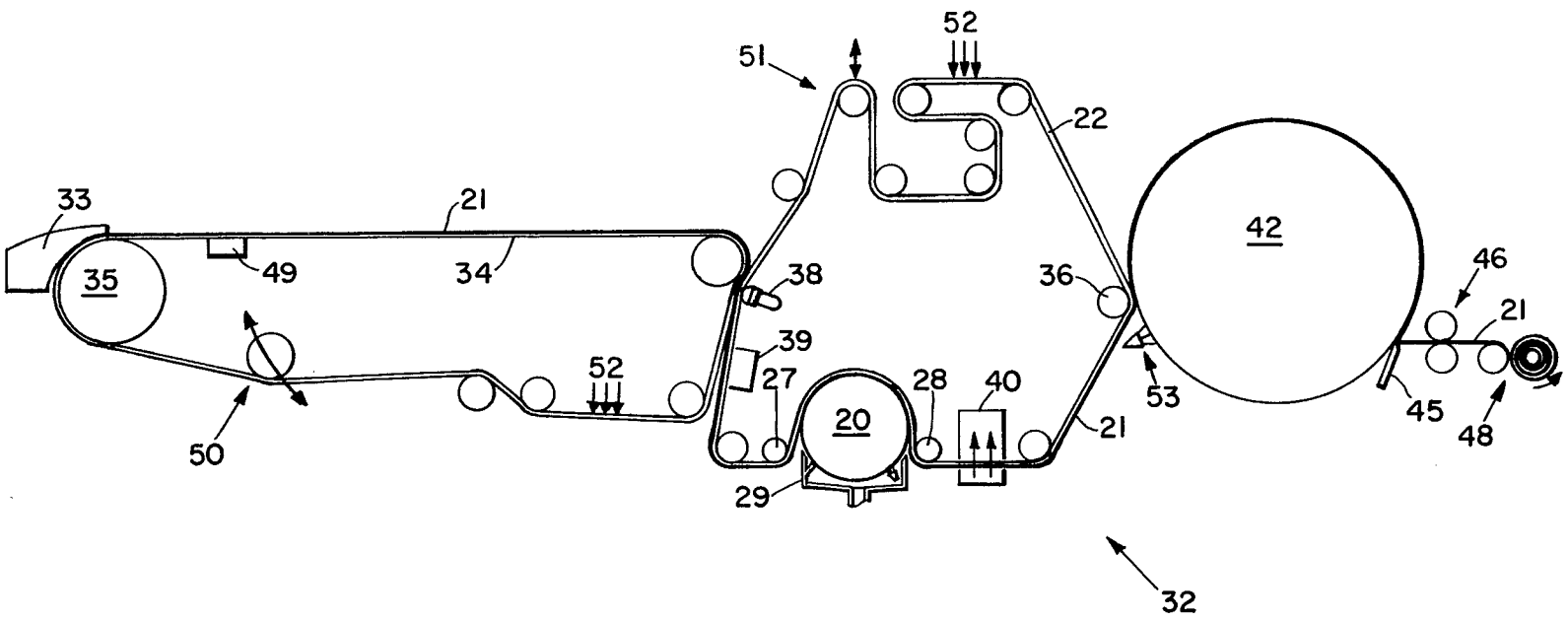
FIG. 2 is a somewhat schematic side elevational view of a papermaking machine which incorporates the capillary cylinder shown in FIG. 1.

FIG. 2 is a somewhat schematic side elevational view of an exemplary papermaking machine 32 for making high bulk tissue paper which machine comprises a capillary cylinder 20, FIG. 1, in accordance with the present invention. But for the inclusion of the capillary cylinder 20 and the ancillary apparatus shown in FIGS. 1 and 2, papermaking machine 32 is of the general type shown and described in U.S. Pat. No. 3,301,746 which issued Jan. 31, 1967 to L. H. Sanford and J. B. Sisson, and which patent is incorporated herein to obviate the need for a detailed description of the well known conventional aspects of such a papermaking machine and its operation. By way of orientation, however, the major elements of papermaking machine 32 include a headbox 33; a Fourdrinier wire 34 which is looped about a number of rolls including breast roll 35; the carrier fabric 22 which preferably is a foraminous polyester imprinting fabric which is looped about a plurality of guide rolls including pressure roll 36, over a vacuum-type transfer head 38 and vacuum box 39, and through a blow through hot air dryer 40; a Yankee dryer drum 42; creping means 45; a calender assembly 46; and reeling means 48. Additionally, such papermaking machines commonly comprise additional features such as but not limited to Fourdrinier tensioning means 50, carrier or imprinting fabric tensioning means 51, fabric cleaning showers 52, and creping adhesive applicator means 53. Preferably, in operation, a papermaking furnish issues from headbox 33 onto Fourdrinier wire 34 whereon preliminary dewatering is effected by one or more vacuum boxes 49, and by gravitational drainage through the Fourdrinier wire. The newly formed web 21 is then transferred to carrier fabric 22 when it has a nominal fiber consistency of from about six (6) percent to about twenty (20) percent: more preferably from about twelve (12) percent to about eighteen (18) percent. Additional dewatering may be effected by vacuum box 39 so that the web has a nominal fiber consistency of about twenty-seven (27) percent or less and more preferably about twenty (20) or less percent as it is led onto capillary cylinder 20 after looping about idler roll 27. However, webs having even higher fiber consistencies can be effectively dewatered by capillary cylinders in accordance with the present invention by providing means for establishing hydraulic connections between water disposed in the pores of the web and the entrances to the pores of the porous cover: for example, as by wetting the porous cover just prior to leading the web onto the porous cover. Indeed such wetting of the porous cover may be efficatious at fiber consistencies even lower than about twenty-seven (27) percent. After having substantial additional water removed upon passing about capillary cylinder 20, web 21 passes through dryer 40, and thence onto and away from the Yankee dryer 42 to be calendered to suit, and reeled. Such reeled, high bulk paper is then commonly converted into finished paper products such as toilet tissue, facial tissue, and paper towels by converting apparatus, none of which is shown in the figures.

Referring again to FIG. 1, the rotatably mounted shell 23 comprises a porous cover 55 over a skeletal framework 56. Fragmentary portions of porous cover 55 are shown in FIGS. *3a* through *3g*, inclusive, and it is more fully described hereinafter. The skeletal framework has a cylindrical shape and preferably comprises a plurality of circumferentially spaced, longitudinally extending longerons, and a plurality of longitudinally spaced hoop-shape ribs. The longerons and ribs are spaced and configured to provide sufficient structural support to maintain the porous cover attached thereto in a substantially true circular cylindrical shape during operation; and to obviate blocking a substantial portion of the pores of the porous cover 55. The inwardly facing portions of the longerons and the ribs corporately define the inner diameter ID of shell 23. They are machined to provide a true right circular cylindrical inner diameter ID for the purpose of providing a continuum of lands which slide over stationary, sector-dividing, sliding-type seals as shell 23 is rotated on its axis of revolution. These seals are designated 68, and their function will be described more fully below.

The stationary manifold assembly 25, FIG. 1, comprises a tubular member 60, partitions 61 through 66, and a longitudinally extending sliding-type seal 68 disposed along the longitudinally extending distal edge of each of the partitions 61–66. The partitions 61–66 extend radially outwardly from tubular member 60 and extend the full axial length of capillary cylinder 20, as do sliding seals 68. The sliding seals 68 are preferably pneumatically biased radially outwardly by a slight pressure by means not shown to maintain contacting relationships with the inwardly facing surfaces (i.e. the lands) of skeletal framework 56 albeit the ID may not be precisely true, and to compensate for wear during usage.

The stationary manifold assembly 25, FIG. 1, further comprises end plates and sliding-type end seals, none of which are shown, to complete the definition of sectorial chambers 71–76; and a plurality of tubular conduits 81–86 which are selectively vented, or connected to pressure controllable vacuum or pneumatic means not shown. Preferably, as will be more fully described below, sectorial chamber 71 (i.e., the chamber disposed subjacent the sector of cylinder 20 upon which web 21 comes into contacting relation with shell 23) is maintained at a slightly positive pressure; sectorial chamber 72 is maintained at a moderate level of vacuum; sectorial chamber 73 is maintained at a level of vacuum somewhat greater than sectorial chamber 72; sectorial chamber 74 is vented to ambient atmospheric pressure; sectorial chamber 75 is sufficiently pressurized above ambient atmospheric pressure to outwardly pneumatically expel the water which is removed from web 21 from the pores of porous cover 55 into trough 29 from which it is subsequently drained via tube 90; and sectorial chamber 76 is vented to ambient atmospheric pressure. The level of vacuum in sectorial chamber 72 is preferably not as hard as in sectorial chamber 73 in order to provide a stepwise application of vacuum to the pores of porous cover 55 rather than applying a high level of vacuum in one increment. Corporately, the porous cover, the skeletal framework, the seals and the other elements of cylinder 20 comprise means for substantially obviating circumferential leakage of air or vacuum for the purpose of saving energy which would otherwise be wasted through such leakage.

FIGS. *3a* through *3g* are fragmentary sectional views taken along section lines *3a—3a* through *3g—3g*, respectively of FIG. 1; and they depict a preferred operational sequence of capillary cylinder 20 as it rotates. Each of these views shows a greatly enlarged fragmentary portion of porous cover 55 having a single pore 90, an outwardly facing surface 91, an inwardly facing surface 92, and some amount of water 94 in pore 91. None of skeletal framework 56, FIG. 1, is shown in FIGS. *3a* through *3g*.

In FIG. *3a*, the paper web 21 is being carried on carrier fabric 22 along a convergent path towards surface 91. The water 94 disposed in pore 90 has a meniscus 97 which as shown in FIG. *3a* has a slightly convex shape at surface 91 due to maintaining a slight positive pneumatic pressure in sectorial chamber 71, FIG. 1. Meniscus 97 is provided with the convex shape to obviate trapping air intermediate web 21 and the residual water 94 in pore 90 as would occur with a concave meniscus. Alternatively, controlling the pressure in sectorial chamber 71 to cause the outwardly facing surface of water 94 to merely be flush with surface 91 would also obviate such trapping of air in the outboard ends of pores 90. The inwardly facing meniscus 98 is shown to be concave to indicate that porous cover 55 comprises material which is wettable by water 94 as it preferably is for practicing the present invention.

Still referring to FIG. *3a*, carrier fabric 22 is shown to comprise longitudinally extending monofilament warps 95 and cross-machine direction extending monofilament shutes 96. Such a foraminous, woven fabric enables ambient air to act on web 21 to enable preferential capillary transfer of water from web 21 into pores 90 as described above. However, as shown in FIGS. 3*a* through 3*e*, the openings in the interfilamentary spaces in carrier fabric 22 and the thickness of web 21 appear to be the same order of size as pore 90 which is not the case, but which is precipitated by greatly exaggerating the diameter of pore 90 to facilitate discussing its characteristics and functions. In actual fact, the diameter of pore 90 is extremely small compared to the interfilamentary spaces in commonly used carrier fabrics, and compared to the thickness of common paper webs and the like. For example and not by way of limitation, pores 90 preferably have nominal effective diameters of from about five (5) to about ten (10) microns, and more preferably from about five (5) to about seven (7) microns, albeit effective but slower water transfer can be achieved with smaller pore sizes, all other things being constant; and are preferably so spaced and configured to substantially obviate lateral inter-pore connections.

Figure 3B:
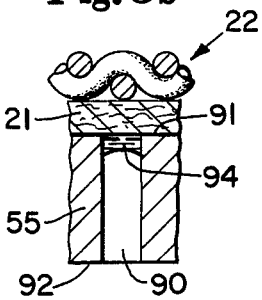

FIG. 3*b* shows the elements of FIG. 3*a* after web 21 has come into contacting relation with the outwardly facing surface 91 of porous cover 55. The absence of a discrete meniscus in FIG. 3*b* indicates that the water disposed in web 21 has achieved a liquid-to-liquid continuity relation with the water 94 disposed in pore 90; and that no air is trapped therebetween. So disposed, the pneumatic pressure differential between ambient atmospheric pressure above the web and the level of vacuum in sectorial chamber 72 acts to push water from in the web into the pores of the porous cover without airflow through the porous cover. Thus, air flow into the vacuum system through the pores is obviated. This results in great energy savings in the vacuum system; and, enables achieving a higher level of fiber consistency in the web than with conventional vacuum dewatering boxes. This additional water removal, in turn, results in large thermal energy savings in drying the web: e.g., in dryer 40 and on Yankee 42. Also, by showing web 21 in FIG. 3*b* to be equal in thickness to web 21 in FIG. 3*a*, it is intended to manifest that the tension in carrier fabric 22 is maintained at a low enough value to substantially obviate compaction of web 21 as it passes over capillary cylinder 20, FIG. 1. This enables such apparatus to produce high bulk paper as described hereinbefore while concomitantly conserving much energy: i.e., vacuum system and thermal.

Figure 3C:
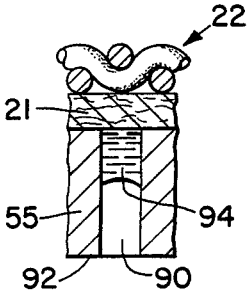

FIG. 3*c* shows the elements shown in FIG. 3*b* after some exposure to vacuums being maintained in sectorial sections 72 and 73. That is, these lower-than ambient-atmospheric pressures have augmented the preferential capillary forces extant between web 21 and pores 90, and have caused some water 94 to be transferred (i.e., pushed) from web 21 into the pore 90 shown.

Figure 3D:
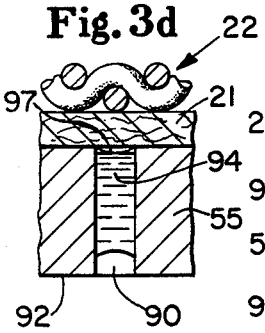

FIG. 3*d* shows the elements shown in FIG. 3*c* after sufficient water 94 has been transferred from web 21 into pore 90 to break the liquid-to-liquid continuity between the water remaining in the pores of web 21 and the water 94 disposed in pore 90. In this state, the outwardly facing meniscus 97 has assumed a concave geometry due to the water 94 wetting the surface of porous cover 55 which defines pore 90; and it shows that a small air pocket is disposed intermediate web 21 and water 94 in pore 90.

Figure 3E:
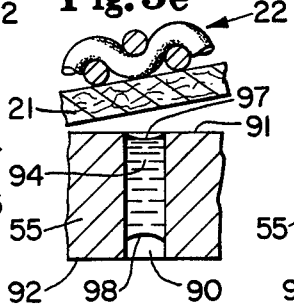

FIG. 3*e* shows the elements shown in FIG. 3*d* just after web 21 and carrier fabric 22 have commenced to diverge from porous cover 55. At this point (i.e., the location of section line 3*e*—3*e* in FIG. 1) the column of water 94 disposed in pore 90 is static in pore 90, and has concave menisci at both ends; i.e., menisci 97 and 98. However, the menisci 97 and 98 will not be precisely symmetrical due to the centrigual force on liquid 94 which in turn is due to the rotation of capillary cylinder 20, FIG. 1.

Figure 3F:
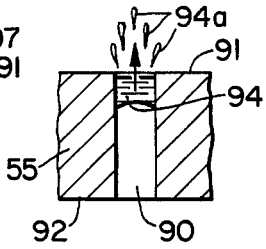

FIG. 3*f* somewhat schematically depicts the outward pneumatic expulsion of water 94 from pore 90 by the arrow and by the droplets 94*a*. This expulsion is precipitated by positive pneumatic pressure in sectorial chamber 75, FIG. 1, which acts upwardly on the base of the column of water 94 in pore 90 as it is oriented in FIG. 3*f*. In order to so expell water from such capillaries, the pressure subjacent the porous cover 55 must be greater than the inherent capillary forces present in water 94. Accordingly, to enable water expulsion yet prevent total blow-out of water 94 from pore 90, the pressure subjacent porous cover 55 must be controlled at a sufficient level to precipitate expulsion but preferably not great enough to cause total expulsion in the period of time each pore is exposed to sectorial chamber 75 each revolution of cylinder 20. Also, albeit some expelled water 94 is shown in FIG. 3*e* to have become droplets 94*a*, the water may indeed retain a cohesive means character due to surface tension and simply accumulate on the outer surface 91 from which it would then be doctored by doctor blade 24, FIG. 1.

Figure 3G:
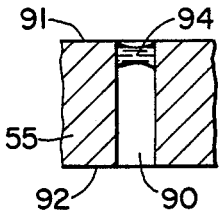

FIG. 3*g* shows a relatively short residual column of water 94 remaining in pore 90 after the rotation of capillary cylinder 20, FIG. 1, has moved the fragmentary portion of porous cover 55 depicted in FIG. 3*g* to place pore 90 in pneumatic communication with sectorial chamber 76, FIG. 1. Sectorial chamber 76 is preferably vented to ambient atmospheric pressure. The residual water 94 disposed in pore 90 constitutes a liquid-seal which, within limits, acts to obviate both vacuum and positive pressure induced air flow through the pores 90 of porous cover 55. That is, within a pressure differential range which is dependent on pore diameter, pore geometry, and the wetting angle of the water 94 with respect to the surface defining pore 90, vacuum applied in sectorial chambers 72 and 73 will augment capillary transfer of water from web 21 into pores 90 but the water in the column will act as a seal to obviate vacuum motivated gas flow through the pores. Additionally, in operation, the level of positive pneumatic pressure in sectorial chamber 75 can be controlled as stated above to remove all of the water from pores 90 each revolution of capillary cylinder 20, FIG. 1, except a sufficient amount of water 94 to maintain liquid-seals therein as disclosed above and as depicted in FIG. 3*g*. This obviates gas flow through pore 90 which would otherwise be precipitated by maintaining a greater positive pneumatic pressure in sectorial chamber 75, FIG. 1. Thus, maintaining liquid-seals in pores 90 conserves energy which would otherwise be expended to supply vacuum and compressed air. Accordingly, while it is not intended to limit the present invention to requiring either liquid-seals or liquid-to-liquid continuity as described hereinbefore, such are preferred and are believed to be necessary to achieve the maximum water removal efficiency possible through the use of such preferential capillary cylinders in accordance with the present invention. Relative water removal efficiency is hereby defined as the weight of water removed from the web by a capillary cylinder embodying the present invention per unit of energy expended to effect that water removal from the web and then outwardly pneumatically expelling or otherwise removing the water from the capillary cylinders.

Referring again to FIG. 3*a*, the pneumatic pressure that is applied to precipitate the convex shape of meniscus 97 is preferably lower than the level that would blow the liquid seal (i.e., the residual water 94) out of pore 90 to further conserve energy.

Referring again to FIGS. 3*d* and 3*e*, it is manifest that the corporate volume of pores 90 per unit area is greater than the sum of the volume of residual water 94, FIG. 3*a*, added to the volume of water per unit area that is removed from web 21 by operating capillary cylinder 20, FIG. 1, as described above. That volumetric relationship is the primary structural difference between the porous cover 55, FIGS. 3*a* through 3*g*, and the porous cover 155 which is described below and shown in FIGS. 4*a* through 4*g* to be substantially thinner than porous cover 55.

ALTERNATE METHODS OF OPERATING POROUS CYLINDER 20, FIG. 1

Briefly, the above described preferred method of operating capillary cylinder 20, FIG. 1, which comprises a porous cover 55, FIGS. 3*a* through 3*g*, includes maintaining controlled levels of vacuum in sectorial chambers 72 and 73, and maintaining liquid seals in the pores of the porous cover. However, when the pores of porous cover 55 are in fact sized and configured to effect preferential capillary flow of water from a web to be dewatered into the pores of the porous cover, while being subjected to the centrifugal force induced by rotating capillary cylinder 20, the water transfer will in fact occur without applying the vacuum. But, such transfer is of course slower than with vacuum augmentation. Accordingly, such a capillary cylinder would necessarily have to have a larger diameter—all other things being equal—to provide sufficient web residence time to effect the desired degree of dewatering at contemporary papermaking speeds. Moreover, this (i.e., water transfer without vacuum augmentation) could be effected with or without liquid-seals in the pores of the porous cover. In this event, the pressure is sectorial chamber 75 would desirably be controlled at a level to complete clearing all of the water from pores 90 just before they pass doctor blade 24 in order to achieve energy loss by excessive flow of compressed air through pores 90 which are not covered by web 21.

Additional operational and/or structural changes may be made with respect to the preferred description of the present invention described above. Generally speaking, the number and span of the sectorial chambers, and the level of gaseous pressure maintained in each may be changed so long as such changes do not substantially vitiate the capability of the apparatus to effect substantial dewatering of the web and water removal from the cylinder without incurring substantial air flow through the porous cover; and so long as the web will release from the cylinder and be forwarded on the carrier fabric. Accordingly, by way of example and not of limitation: partition 63 may be removed and/or sectorial chamber 72 and 73 otherwise maintained at the same level of vacuum: partition 64 may be removed or sectorial chambers 73 and 74 otherwise operated at the same level of vacuum (i.e., without venting sectorial chamber 74). Moreover, the volume of water per unit area of web may be greater than the transfer capability of the system due to time or pressure constraints, or may otherwise be greater than the volume of water per unit area of web that the operator wishes to transfer into pores 90. In either of these events, the liquid-to-liquid continuity between the water in the web and in the pores 90 would not break in the manner described above with respect to FIG. 3*d*. Rather, in either of these events, the liquid-to-liquid continuity between the water in web 21 and pores 90 would be broken upon web 21 being led away from the porous cover 55, FIG. 3*e*, on carrier fabric 22. In such cases, sufficient water can still be present to present the web to another capillary cylinder disposed downstream from the first capillary cylinder in order to continue the pneumatically augmented capillary web dewatering process. That is, of course, an alternative to simply making one capillary cylinder sufficiently large to insure that it has the capacity and capability of removing sufficient water from the web to assure breaking the liquid-to-liquid continuity described above with respect to FIG. 3*d*.

As described above, the operation of capillary cylinder 20 in a papermaking machine indeed provides a dynamic web dewatering means by either purely preferential capillary action or by pneumatically (e.g., vacuum) augmented capillary transfer; and by reversing the flow of the water to pneumatically expel it outwardly from a sector of the cylinder not wrapped by the web. This cyclical flow reversal acts to keep the pores and/or their entrances from clogging as they would be prone to do with unidirectional flow. Also, when operated within the above described limits of differential pneumatic pressure to maintain liquid-seals in the pores of the porous cover of the capillary cylinder, energy is conserved by obviating both vacuum induced and pressurized air flow through the pores. Indeed, the control of the level of vacuum for dewatering the web, and the level of pneumatic pressure for expelling water from the pores of the porous cover without blowing out the liquid-seals can be automatically controlled through the use of control means not shown but responsive to, for example, air flow sensing means. Such automatic controls can maintain maximum pneumatic pressure differentials just below the values at which the liquid-seals would be blown out of the pores of the porous cover, and thereby maximize the water removal capacity of the capillary cylinder at a substantially zero flow of air through the pores. This would maximize energy savings by obviating substantial air flow through the pores of the porous cover of the capillary cylinder. Of course, the more narrow the pore-size range of the pores in the porous cover, the better this control would be and the more energy efficient the capillary cylinder would be.

ALTERNATE CAPILLARY CYLINDER EMBODIMENT HAVING THIN-WALLED POROUS COVER

Sectional, fragmentary portions of an alternate embodiment porous cover 155 is shown in FIGS. 4*a* through 4*g* along with fragmentary portions of web 21 and carrier fabric 22 as though taken along section lines 3*a* through 3*g*, respectively, of an alternate embodiment capillary cylinder which comprises porous cover 155 rather than porous cover 55, FIGS. 3*a* through 3*g*, inclusive. Porous cover 155 is relatively thin compared to porous cover 55. Accordingly, for pores of a given size or range of sizes and a given density, the pore volume of porous cover 155 is proportionally less than for porous cover 55: that is, their relative volumes are proportional to their respective thickness.

Figure 4C:
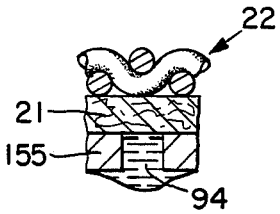
Figure 4D:
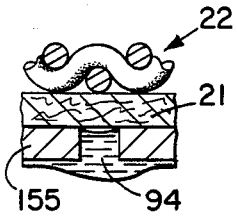
Figure 4E:
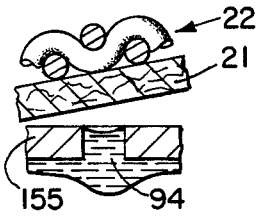
Figure 4F:
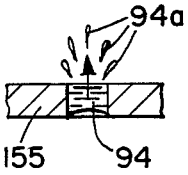
Figure 4G:
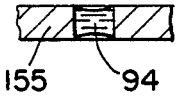

As shown in FIGS. 4*a* through 4*g*, it is apparent that the volume of water 94 which is being removed from web 21 per unit area thereof exceeds the volume of pores 94 per unit area of porous cover 155. Accordingly, during such dewatering of web 21 as depicted in these views, the excess water 94 accumulates inside porous cover 155 as shown in FIGS. 4*c* through 4*e*, and is disposed therein until outwardly expelled as shown in FIG. 4*f*. Of course, such accumulation inside porous cover 155 requires a pneumatic differential pressure acting from above the web 21 towards the interior of the capillary cylinder. Preferably, the pneumatic differential is provided by a suitably controllable vacuum means not shown. Otherwise, the functions of and operation of an alternate capillary cylinder comprising a relatively thin porous cover 155. FIG. 4*a*, rather than a relatively thick porous cover 55, FIG. 3*a*, is substantially the same as for capillary cylinder 20, FIG. 1. Moreover, the above described alternate methods of operating capillary cylinder 20 having a relatively thick porous cover 55 generally apply to the alternate embodiment capillary cylinder having a thin porous cover 155. Accordingly, redundant discussions thereof are omitted herefrom.

ALTERNATE CAPILLARY CYLINDER EMBODIMENT HAVING WOVEN-WIRE POROUS COVER

FIGS. 5 and 6 are enlarged scale, top and side elevational views, respectively, of fragmentary portions of a woven wire, alternate embodiment porous cover 255 which has been woven in what is generically called a Double Dutch Twill Weave. As shown in FIG. 5, the warps 202 (i.e., the machine-direction wires) of this weave have substantially larger diameters than the diameters of the shutes 201 (i.e., cross-machine direction wires). Thus, if the warps 202 and shutes 201 are of the same bendable material (as they preferably are), the shutes are easier to bend than the warps. Accordingly, as the shutes 201 are sequentially woven into place in the two-over, two-under, staggered pattern depicted in FIGS. 5 and 6, they are crowded together into overlapping relation without substantially bending the warps 202. Such weaves commonly have shute counts that are up to about two times the theoretical shute count if such overlapping of the shutes were not precipitated. Such woven wire fabrics have intricate interconnected passageways or pores through them; and can be woven with such fine wires that the passageways/pores manifest preferential capillarity with respect to, for example, high-bulk tissue paper as described hereinbefore albeit such pores are irregular in cross-section rather than being cylindrical or some other tubular shape having generally uniform cross-sections throughout their lengths. U.S. Pat. No. 3,327,866 which issued June 27, 1967 to D. B. Pall et al discloses such woven fabrics, and their pore sizes as functions of "Warp Count", "Warp Diameter", "Shoot [Sic] Diameter", and "Shoot [Sic] Count", as well as other parameters of such woven fabrics: particularly for use as filter media. Accordingly, that patent is also incorporated herein by reference although it is not intended to limit woven-wire embodiments of the present invention to only the Double Dutch Twill Weave.

Sintered multi-layer woven wire fabrics wherein an intermediate layer is such a Double Dutch Twill Weave as described above are commercially available and are commonly used in filtration apparatus: for example for separating blood components. One commercial source is the Filter Products Division of Facet Enterprises, Inc., Madison Heights, Mich. The layers are sintered together to achieve corporate structural rigidity. Of course, interposing a layer of coarse mesh woven fabric between web 21 and the outside surface 91 of porous cover 55, FIG. 3*a*, would obviate preferential capillary action in accordance with the present invention due to lateral and longitudinal leakage paths. Accordingly, such a coarse-weave exterior layer on porous cover 255, FIGS. 5 and 6, would substantially if not totally defeat the intended preferential capillarity thereof with respect to newly formed, water saturated paper webs and the like.

Porous cover 255, FIGS. 5 and 6, preferably further comprises layers of progressively coarser mesh woven wire fabrics not shown which are disposed subjacent the finest mesh woven fabric, and the layers are sintered together as stated above. For example and not by way of limitation, such woven fabrics are preferably woven for structural integrity reasons with mesh counts and wire sizes to provide open areas of about fifteen (15) percent or less or, more preferably about five (5) percent or less or, most preferably, about two (2) percent or less.

An exemplary embodiment of such a composite woven wire fabric has a nominal warp count of 325 warps per inch (about 128 warps per centimeter), and a nominal shute count of 2300 shutes per inch (about 906 shutes per centimeter); and the nominal diameters of the warps and shutes are about thirty-eight (38) microns, and twenty-five (25) microns, respectively. The warps and shutes were made of 316L stainless steel.

A cylindrical skeleton such as described above and having a diameter of about thirty inches (about 76 centimeters) was covered with this wire fabric, and was operated in a papermaking machine of the general type shown in FIG. 2, at web speeds of up to about sixteen hundred feet per minute (about 490 meters per minute) and a web fiber consistency of from about twenty-two (22) to about twenty-seven (27) percent going onto the cylinder. Dewatering to about thirty-three (33) percent web fiber consistency by weight was achieved while maintaining about four-and-one-half (4½) inches (about 11.4 cm) of mercury vacuum in sectorial chamber 72, and about six (6) inches (about 15.2) of mercury vacuum in sectorial chamber 73 although it is not intended to thereby impute limitations to the present invention. Rather, capillary cylinders may be used in accordance with the present invention at input fiber consistencies less than about six (6) percent; but more preferably in the range of from about six (6) to about twenty-seven (27) percent web fiber consistency by weight. However, low fiber consistencies require the capillary cylinder to be placed upstream from a vacuum transfer point: e.g., in a Fourdrinier run as exemplified by the papermaking machine shown in FIG. 8 and described more fully below; and, as stated hereinbefore, high fiber consistencies may require wetting the porous cover before leading the web into contacting relation therewith. Additionally, dewatering up to about forty (40) percent or even higher fiber consistency may be achieved by the present invention through the use of porous covers having finer pores: e.g., woven wire covers which have been woven from finer wires; and/or woven wire covers which have been plated and/or calendered to reduce their pore sizes; and or porous covers having tubular pores such as shown in FIGS. 3*a* through 3*g*, and FIGS. 4*a* through 4*g*.

While not intending to be bound by a theory of operation, it is believed that, in operation, embodiments of the present invention which comprise woven-wire porous covers act like the thin-walled capillary structure described hereinabove. That is, that water removed from the web would flow through the pores of the porous cover to accumulate in the interstitial voids of the coarser mesh layers of the cover until acted on by pneumatic pressure to reverse the flow through the pores to expell the water outwardly.

FIG. 7 is a sectional view of a fragmentary portion of a porous cover 255*s* having a somewhat hourglass-shape pore 290*s*. This is shown in the same respective relationship with a web 21 and carrier fabric 22 as are porous covers 55 and 155 in FIGS. 3*a* and 4*a*, respectively: that is, just before web 21 is led into contacting relation therewith. However, in FIG. 7, the residual water 94 disposed in pore 290*s* extends below the smallest diameter portion of the pore. This is preferred in order to assure more positive protection against blowing the water (i.e., the liquid-seal) out of the pore when it is subjected to a positive pressure as when it is superjacent a sectorial chamber such as 71, FIG. 1.

In part, the porous cover 255*s*, FIG. 7, is illustrated to facilitate by way of analogy, understanding the operation of a porous cover having irregular-shape pores without attempting to develop two dimensional drawings of such complex three-dimensional passageways or pores as are inherent in porous cover 255, FIGS. 5 and 6.

FIG. 8 is a somewhat schematic side elevational view of an exemplary alternate papermaking machine 132 with which the present invention may be practiced. Corresponding components of both machines 32 and 132 are identically designated; and the following description primarily deals with their differences to obviate the need for redundant descriptions. Also, elements thereof which are not structurally identical but which have corresponding functions are identified by designators which are one-hundred greater for machine 132 than for machine 32: e.g., the designator for papermaking machine 132 is one-hundred greater than the designator for papermaking machine 32.

Briefly, papermaking machine 132 comprises a capillary cylinder 120 and its ancillary apparatus on the run of the Fourdrinier wire 34; has water removal hydrofoils 154 disposed where vacuum box 49 is disposed in papermaking machine 32; but does not include the vacuum box 39, the capillary cylinder 20, or the dryer 40 of papermaking machine 32. The ancillary apparatus associated with capillary cylinder 120 includes guide rolls 127 and 128, and a water-catch-trough 129 which are functionally equivalent to rolls 27 and 28, and trough 29, respectively, of papermaking machine 32. When papermaking machine 132 is operated, capillary cylinder 120 is preferably operated and controlled in the manner described herebefore with respect to capillary cylinder 20, FIGS. 1 and 2.

SERIES RELATED CAPILLARY CYLINDERS

FIG. 9 is a somewhat schematic side elevational view of an exemplary alternate papermaking machine 232 which comprises two capillary cylinders 20, and 120 in accordance with the present invention. But for having two capillary cylinders which are preferably functionally identical, papermaking machine 132 is configured and operated like paper machine 32 and 132, FIGS. 2 and 8, respectively. Accordingly, corresponding components of all of these machines are identically designated; and the following description primarily deals with their differences to obviate the need for redundant descriptions as was done above with respect to describing papermaking machine 132.

Briefly, papermaking machine 232 comprises the capillary cylinders 20 and 120 of papermaking machines 32 and 132, respectively, and has them disposed in series relation. However, papermaking machine 232 does not have a blow-through dryer 40 inasmuch as the need therefor is obviated albeit a dryer such as 40 has been found to be quite useful during start-up. When papermaking machine 232 is operated, both capillary cylinder 120 and capillary cylinder 20 are preferably operated and controlled in the manner described herebefore with respect to capillary cylinder 20, FIGS. 1 and 2, except that preferably insufficient water is removed from the web 21 by cylinder 120 to break the liquid-to-liquid continuity between the water in web 21 and in the pores of the porous cover of cylinder 120. This is preferably done to ensure effecting liquid-to-liquid continuity between the residual water in the web and the liquid-seal water in the pores of cylinder 20 when the web is subsequently led onto cylinder 20.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of this invention.

What is claimed is:

1. A method of removing liquid from a continuous wet porous web on the run without inducing substantial compaction of the web, said method comprising the steps of:

looping the running web directly onto and about a rotatably mounted cylinder so that said web wraps only a predetermined first sector of said cylinder, said cylinder having a porous shell wherein the pores are preferential-capillary-size which are effectively smaller than the pores of said web whereby some of said liquid is capillarily transferred from said web into said pores of said porous shell;

drawing vacuum within said first sector of said cylinder immediately subjacent said porous shell to precipitate a sufficient pneumatic pressure differential across said web and said shell to pneumatically augment capillary transfer of liquid from said web into said cylinder via said pores in said porous shell as said web traverses said sector;

leading said web from said cylinder at the downstream end of said sector; and pneumatically outwardly expelling said liquid from another sector of said shell which is not covered by said web.

2. The method of claim 1 further comprising controlling said vacuum to maximize the amount of liquid transferred from said web while concomitantly maintaining liquid-seals in said pores of said porous shell.

3. The method of claim 1 further comprising controlling said pneumatic pressure to maximize the expulsion of said liquid while concomitantly maintaining liquid-seals in said pores of said porous shell.

4. The method of claim 1, wherein the surfaces of said shell which contact said liquid are so constituted that said liquid will have contact angles with said surfaces of less than ninety degrees.

5. The method of claim 4 wherein said contact angles are less than about sixty degrees.

6. The method of claim 1 wherein said preferential-size-capillary pores are uniformly sized and configured.

7. The method of claim 6 wherein said preferential-size-capillary pores have a nominal effective diameter in the range of from about five microns to about ten microns.

8. The method of claim 7 wherein said nominal effective diameter is in the range of from about five to about seven microns.

9. The method of claim 6 wherein said preferential-size-capillary pores have nominal effective diameters of about seven microns or less.

10. An apparatus for removing liquid from a running wet porous web without inducing substantial compaction of the running web, said apparatus comprising:

a rotatably mounted capillary cylinder having a porous shell having preferential-capillary-size pores which are effectively smaller than the pores of the running web;

means for rotating said porous shell about the axis of said cylinder;

substantially non-compressive means for leading the running web onto and off of said cylinder so that the running web wraps a predetermined sector of said cylinder and is in direct contact with the portion of said porous shell spanning said sector;

stationary cylinder compartmenting means for applying a predetermined level of vacuum within said sector subjacent said porous shell to augment capillary transfer of said liquid from the running web into said cylinder; and means for removing from said cylinder sufficient liquid which is transferred from the running web into said cylinder as the running web traverses said wrapped sector thereof to enable continuous such transfer of liquid from the running web into said cylinder as it rotates, said means for removing said liquid comprising pneumatic means for expelling said liquid outwardly from said pores of said porous shell which are not covered by the web.

11. The apparatus of claim 10 wherein said preferential-size-capillary pores are uniformly sized and configured.

12. The apparatus of claim 11 wherein said preferential-size-capillary pores have a nominal effective diameter in the range of from about five microns to about ten microns.

13. The apparatus of claim 12 wherein said nominal effective diameter is in the range of from about five to about seven microns.

14. The apparatus of claim 11 wherein said preferential-size-capillary pores have effective diameters of about seven microns or less.

15. The apparatus of claim 10 further comprising means for controlling said vacuum within said sector for maximizing said liquid transfer from the running web while concomitantly maintaining liquid-seals in said pores of said porous shell.

16. The apparatus of claim 10 wherein said pneumatic means comprises means for controlling the level of pneumatic pressure to maximize the expulsion of said liquid while maintaining liquid-seals in said pores of said porous shell.

* * * * *